US011539111B1

(12) United States Patent
Raybern

(10) Patent No.: US 11,539,111 B1
(45) Date of Patent: Dec. 27, 2022

(54) RAPID RADIO ANTENNA MOUNTING SYSTEM

(71) Applicant: DISH Wireless L.L.C., Englewood, CO (US)

(72) Inventor: Brandon Raybern, Castle Rock, CO (US)

(73) Assignee: DISH Wireless L.L.C., Englewood, CO (US)

( * ) Notice: Subject to any disclaimer, the term of this patent is extended or adjusted under 35 U.S.C. 154(b) by 0 days.

(21) Appl. No.: 17/399,456

(22) Filed: Aug. 11, 2021

(51) Int. Cl.
*H01Q 1/12* (2006.01)

(52) U.S. Cl.
CPC ..... *H01Q 1/1228* (2013.01); *H01Q 1/125* (2013.01); *H01Q 1/1207* (2013.01); *H01Q 1/1264* (2013.01)

(58) Field of Classification Search
CPC .. H01Q 1/1207; H01Q 1/1228; H01Q 1/1242; H01Q 1/125; H01Q 1/1264; F16M 11/02; F16M 11/04; F16M 11/041; F16M 11/06; F16M 11/10
See application file for complete search history.

(56) References Cited

U.S. PATENT DOCUMENTS

2002/0196195 A1* 12/2002 Vermette ..... H01Q 1/125 343/882
2019/0203878 A1* 7/2019 Deng ..... F16M 11/041
2022/0190473 A1* 6/2022 Kim ..... F16M 13/02

* cited by examiner

*Primary Examiner* — Robert Karacsony
(74) *Attorney, Agent, or Firm* — Kilpatrick Townsend & Stockton LLP

(57) ABSTRACT

Mounting systems and methods to secure a radio antenna are provided. A mechanical interlock assembly may include a head section and an insert section. The head section may include a laterally extending portion and a housing adjacent to the laterally extending portion. The head section may be adapted to couple with a pivotable coupling via the laterally extending portion, where the pivotable coupling is adapted to pivotably couple with an antenna assembly. The insert section may be adapted to couple with a pole coupling of a support member of a tower structure. The insert section may be adapted to fit into the housing of the head section, where the housing is adapted to receive the insert section. The insert section may fit into the housing of the head section to mechanically interlock the head section with the insert section to allow suspension of the antenna assembly from the support pole.

20 Claims, 4 Drawing Sheets

RAPID RADIO ANTENNA MOUNTING SYSTEM

Certain embodiments of this disclosure generally relate to antennas, and more particularly to rapid radio antenna mounting systems.

BACKGROUND

With the hundreds of thousands of cellular towers throughout the United States alone, in addition to the millions throughout other countries of the world, installation and deinstallation of radio antennas is a tremendous and important effort. One aspect of such efforts involves removing and/or mounting antennas on support poles of cellular towers at various heights, such as 50 feet, 200 feet, or more. For example, under current work practices, mounting antennas typically requires at least 3 workers to raise, stabilize, and position a radio antenna in an assembled state in order to slide part of the assembly over a support pole of a cellular tower. Several issues are presented by the extremely cumbersome process, including issues redounding in inefficiencies, costs, and risks for personal injury. Additionally, the trend is toward shorter and shorter work windows, with a desire for more productivity. So more effective equipment is needed. These and other needs are addressed by the present disclosure.

BRIEF SUMMARY

Certain embodiments of this disclosure generally relate to antennas, and more particularly to rapid radio antenna mounting systems.

In one aspect, a mounting system to secure a radio antenna is disclosed. The mounting system may include one or a combination of the following. A mechanical interlock assembly may include a head section and an insert section. The head section may include a laterally extending portion and a housing adjacent to the laterally extending portion. The head section may be adapted to couple with a pivotable coupling at least in part via the laterally extending portion, where the pivotable coupling is adapted to pivotably couple with an antenna assembly. The insert section may be adapted to couple with a pole coupling of a support member of a tower structure. The insert section may be adapted to at least partially fit into the housing of the head section, where the housing is adapted to receive at least part of the insert section. The insert section may at least partially fits into the housing of the head section to mechanically interlock the head section with the insert section to allow suspension of the antenna assembly from the support pole.

In another aspect, a method for a mounting system to secure a radio antenna is disclosed. The method may include one or a combination of the following. A head section of a mechanical interlock assembly may be formed to include a laterally extending portion and a housing adjacent to the laterally extending portion. The forming may include adapting the head section to couple with a pivotable coupling at least in part via the laterally extending portion, where the pivotable coupling is adapted to pivotably couple with an antenna assembly. An insert section of the mechanical interlock assembly may be formed, including adapting the insert section to couple with a pole coupling of a support member of a tower structure and adapting the insert section to at least partially fit into the housing of the head section, where the housing is adapted to receive at least part of the insert section. The insert section and the housing of the section are formed so that the insert section at least partially fits into the housing of the head section to mechanically interlock the head section with the insert section to allow suspension of the antenna assembly from the support pole.

In yet another aspect, a method of securing a radio antenna is disclosed. The method may include one or a combination of the following. A head section of a mechanical interlock assembly may be mechanical interlocked with an insert section of the mechanical interlock assembly, where the head section may include a laterally extending portion and a housing adjacent to the laterally extending portion. The head section may be coupled with a pivotable coupling at least in part via the laterally extending portion, where the pivotable coupling is adapted to pivotably couple with an antenna assembly. The insert section may be coupled with a pole coupling of a support member of a tower structure. The insert section may be at least partially fitted into the housing of the head section, where the housing is adapted to receive at least part of the insert section, and the insert section at least partially fits into the housing of the head section to mechanically interlock the head section with the insert section to allow suspension of the antenna assembly from the support pole.

In various embodiments, a first extension member may be engaged with the insert section, where the insert section couples with the support member at least partially with the first extension member. In various embodiments, a second extension member engaged with the head section, where the head section couples with the pivotable coupling at least partially with the second extension member. In various embodiments, the pole coupling may include a quick-release fastener adapted to wrap at least partially around the support member. In various embodiments, the quick-release fastener may include a latch to selectively fasten and release the quick-release fastener. In various embodiments, the housing may be formed to at least partially define a channel adapted to receive at least the part of the insert section.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known processes, structures, and techniques may be shown without unnecessary detail in order to avoid obscuring the embodiments.

Various embodiments will now be discussed in detail with reference to the accompanying figures, beginning with FIG. 1.

Figure 1:
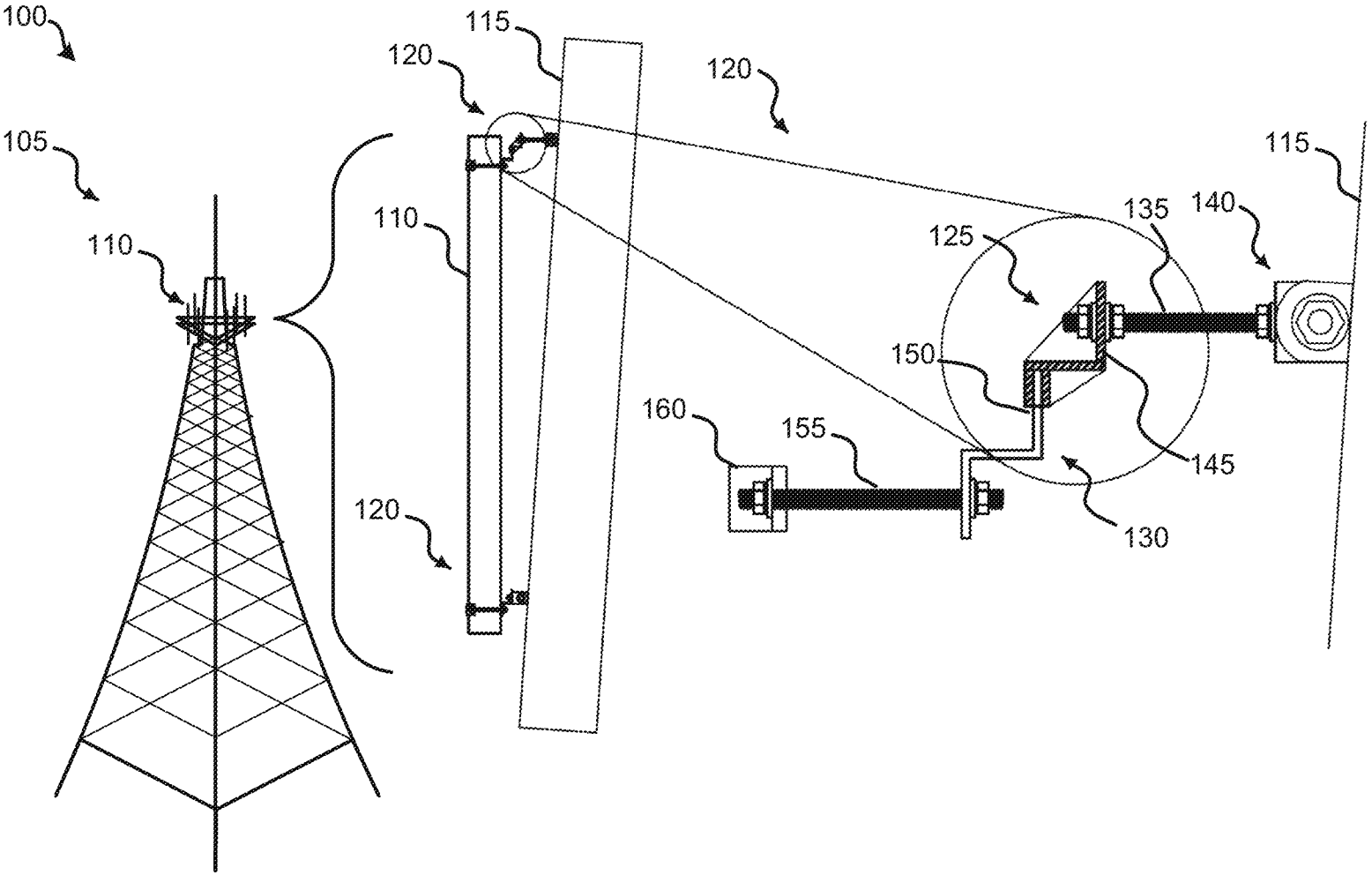
FIG. 1 illustrates two partial close-ups of the mounting system, including an antenna assembly and interlock assemblies, in accordance with certain embodiments of this disclosure.

FIG. 1 illustrates some aspects of a mounting system 100, in accordance with embodiments of present disclosure. For brevity, system 100 is depicted in a simplified and conceptual form, and may generally include more or fewer systems, devices, networks, and/or other components as desired. Further, the number and types of features or elements incorporated within the system 100 may or may not be implementation-specific.

FIG. 1 illustrates a tower structure 105 that may correspond to a cellular tower and may have any suitable configuration and dimensions. A variety of configurations of the tower structure 105 may be employed to facilitate embodiments of this disclosure. The tower structure 105 may have one or more support members 110 attached at one or more suitable points of the tower structure 105 in any suitable manner. A support member 110 may have any suitable dimensions, materials, and characteristics. A support member 110 may, in some instances, correspond to a support pole and/or standoff pipe, being more or less cylindrical, but may correspond to other shapes in other instances. Typically, support members 110 may be disposed such that longitudinal axes of the support members 110 are more or less oriented in a vertical manner as in the example depicted.

FIG. 1 illustrates two partial close-ups of the mounting system 100, including an antenna assembly 115 and interlock assemblies 120, in accordance with certain embodiments of this disclosure. An antenna assembly 115 may be secured to a support member 110 with an interlock assembly 120. The interlock assembly 120 may include a quick linkage system that facilitates quick mounting and dismounting of the antenna assembly 115 from the support member 110. The quick linkage system may advantageously utilize gravity to maintain the antenna assembly 115 in a mounted state with respect to the support member 110. The interlock assembly 120 may be a mechanical interlock assembly 120 particularly configured to support the antenna assembly 115 from the support member 110 such that the interlock assembly 120 allows suspension of the antenna assembly 115 from the support member 110. In some embodiments, the interlock assembly 120 may be adapted to support the antenna assembly 115 such that a single interlock assembly 120 may allow suspension of the antenna assembly 115 from the support member 110. In some embodiments, two or more interlock assemblies 120 may be used to support the antenna assembly 115. In the depicted example, two interlock assemblies 120 are illustrated as supporting the antenna assembly 115. In some embodiments, an alternative to the interlock assembly 120 may be used instead of the bottom interlock assembly 120 to partially secure the antenna assembly 115 in conjunction with the top interlock assembly 120.

In some embodiments, certain interlock assemblies 120 or components thereof may be made from a steel material with a high yield strength, a cast iron material with a high yield strength, and/or the like. In some embodiments, the interlock assemblies 120 or components thereof may be formed at least in part by a metal cutting and/or stamping process of metal that is, for example, approximately ⅛ inch thick, ¼ inch thick, or any one or combinations of various suitable thicknesses. In some embodiments, certain interlock assemblies 120 or components thereof may be made from composite/plastic, a bio-resin, and/or the like. In some embodiments, components of the interlock assemblies 120 may be printed with a 3D printer. Various embodiments may be adapted to hold antenna assemblies 115 that may weigh up to approximately 80 pounds or more with one, two, or more interlock assemblies 120, in any one or combinations of configurations. Further, various embodiments may ensure adequate holding power to suspend the antenna assemblies 115 which may be subject to forces from the environment, such as wind. Certain embodiments of the interlock assemblies 120 may hold the antenna assemblies 115 firmly with capability to react up to approximately 5,000 lbf or more.

The interlock assembly 120 may include a head section 125 and an insert section 130. The head section 125 may include or engage one or more laterally extending portions 135. The head section 125 may include a housing 145 adjacent to the laterally extending portions 135.

Figure 2B:
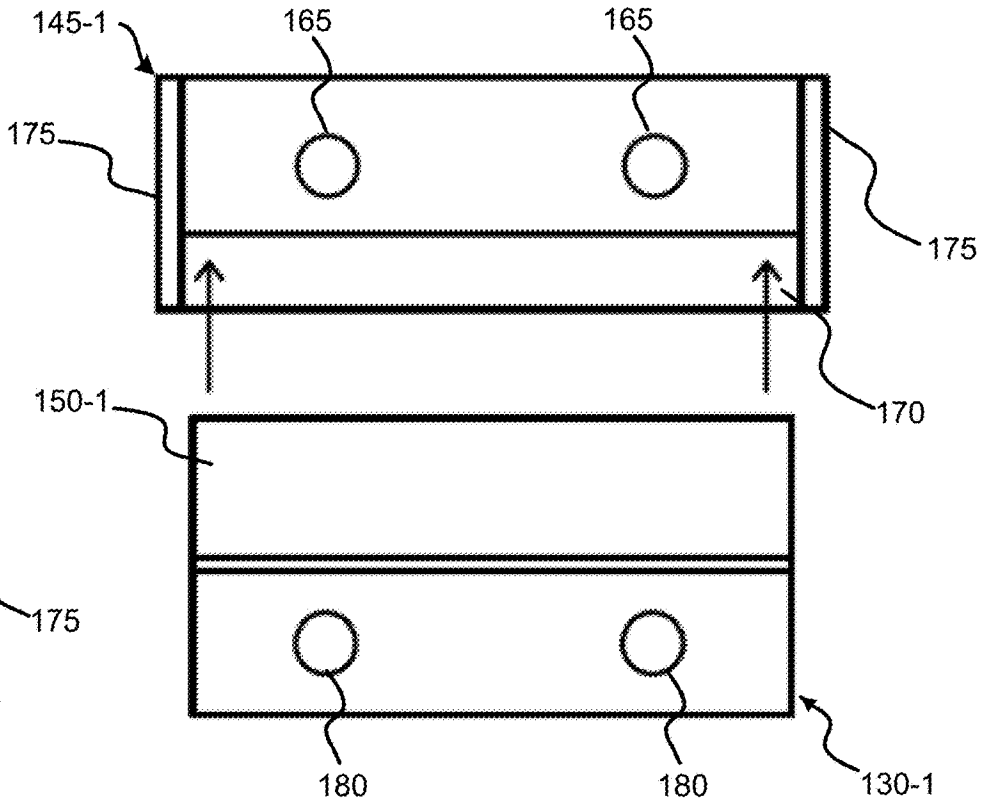
FIG. 2B illustrates a close-up front view of the housing and the insert section, in accordance with certain embodiments of this disclosure.
Figure 2A:
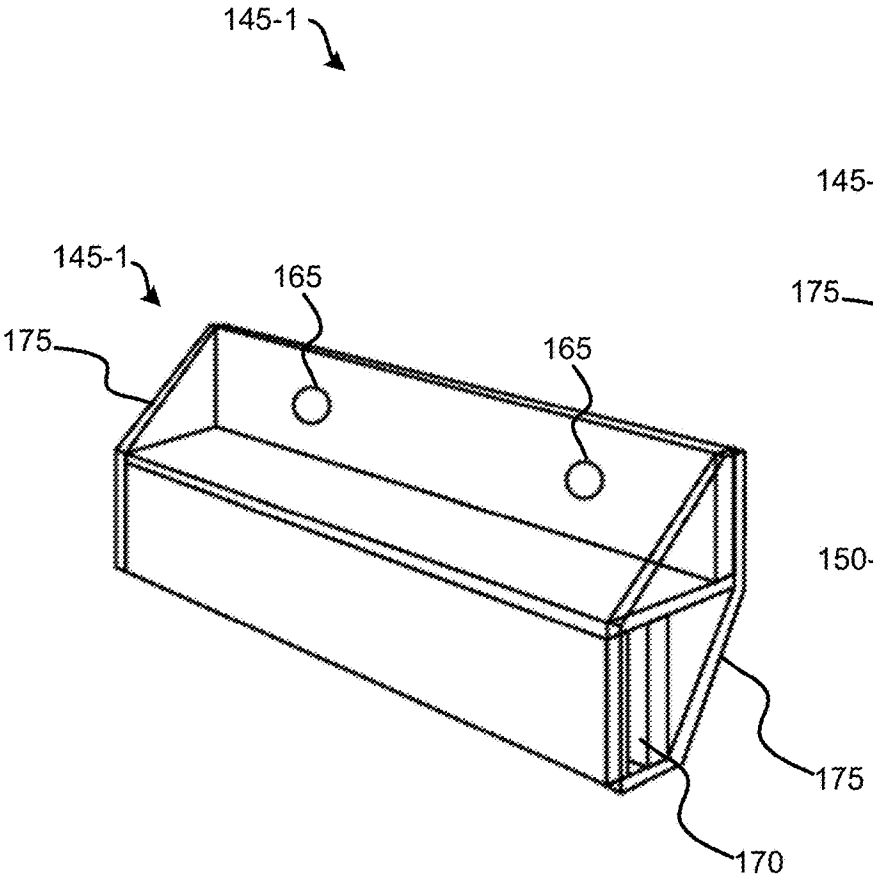
FIG. 2A illustrates a close-up perspective view of the housing, in accordance with certain embodiments of this disclosure.

FIG. 2A illustrates a close-up perspective view of the housing 145, in accordance with certain embodiments of this disclosure. In the depicted example, the housing 145 may include one or more apertures 165 to facilitate engagement with the one or more laterally extending portions 135. The housing 145 may be formed to at least partially define a channel 170. As an example depicted, the channel 170 may extend along a lengthwise dimension of the housing 145 that may be perpendicular to axes of the apertures 165.

As in the example depicted, the housing 145 may be formed to include lateral frame components 175 at ends of the housing 145 provide support and structural integrity between the upper portion of the housing 145 that includes the apertures 165 and the lower portion of the housing 145 that includes the channel 170. Although the lateral frame components 175 are illustrated is transparent for the sake of clarity, the lower lateral frame components 175 may provide for closed ends of the channel 170. The lateral frame components 175 may correspond to support weldments in some embodiments. Additionally, though not illustrated, some embodiments of the insert section 130 may likewise lateral frame components. In such embodiments, the upper lateral frame components may not extend up to the full length of the insert member 150, but may only extend to below the insert member 150 in order to not obstruct insertion of the insert member 150 into the channel 170.

FIG. 2B illustrates a close-up front view of the housing 145 and the insert section 130, in accordance with certain embodiments of this disclosure. As indicated by the illustration, the channel 170 may be formed to receive at least the part of the insert section 130. Accordingly, the housing 145 may be adapted to receive at least part of the insert section 130. For example, the insert section 130 may include an insert member 150 that may be formed to at least partially fit into the housing 145 of the head section 125 to mechanically interlock the head section 125 with the insert section 130 to allow suspension of the antenna assembly 115 from the support pole 110. The insert section 130 may be adapted so that the insert member 150 may extend in a vertical or substantially vertical direction when the interlock assembly 120 is attached to a vertically or substantially vertically oriented support member 110. In this manner, gravity may facilitate the interlocking of the insert member 150 and the housing 145 and provide for gravity-fed placement and securement.

Referring again more particularly to FIG. 1, the head section 125 may be adapted to couple with a pivotable coupling 140 at least in part via the one or more laterally extending portions 135. The pivotable coupling 140 may be adapted to pivotably couple with the antenna assembly 115. For example, the pivotable coupling 140 may include a connector block adapted to at least partially house an axle that is connected to lateral extensions of the antenna assembly 120. In some embodiments, the axle may correspond to a bolt or the like fastened to the lug-like lateral extensions (e.g., via a nuts and washers). In various embodiments, the lug-like lateral extensions may be fastened to, or formed with, the antenna assembly 120.

Each laterally extending portion 135 may be an extension member connected to the connector block of the pivotable coupling 140 via fasteners and/or a threaded connection in some embodiments such that the laterally extending portion 135 threadedly engages the connector block. Likewise, in some embodiments, each laterally extending portion 135 may extend through an aperture 165 of the housing 145 and may be connected to the housing 145 via a threaded connection such that the laterally extending portion 135 threadedly engages the housing 145 and/or fasteners (e.g., nuts and washers). In other embodiments, the laterally extending portion 135 may formed with the housing 145 or welded to the housing 145.

The insert section 130 may be adapted to couple with a support member coupling 160 (e.g., a pole coupling) of the support member 110. The insert section 130 may include or engage a laterally extending portion 155. The laterally extending portion 155 may be an extension member connected to the support member coupling 160, via a threaded connection in some embodiments. Likewise, in some embodiments, the laterally extending portion 155 may extend through an aperture 180 of the insert member 150 and may be connected to the insert member 150 via fasteners (e.g., nuts and washers) and/or a threaded connection such that the laterally extending portion 155 threadedly engages the insert member 150. In other embodiments, the laterally extending portion 155 may formed with the insert member 150 or welded to the insert member 150. As in the example depicted, in some embodiments, the insert member 150 may be formed to include a lateral extension portion so that the insert member 150 is disposed at a distance from the support member 110 when the interlocking assembly 120 is in an installed position.

While the example depicted illustrates the formation of the insert member 150 to include a lateral extension portion by way of right angles, other embodiments are possible, which may include, for example, curvatures instead of right angles. Such embodiments may include the insert section 130 formed to have a U-shape instead of the step shape illustrated. Further, such embodiments may include the housing 145 formed to have an inverted U-shape or other hook shape instead of the step shape illustrated. Still further, some alternative embodiments may provide for an inverted variation of the interlock assembly 120 depicted such that the insert section 130 may be coupled with the antenna assembly 115 and the housing 145 may be coupled with the support member 110. Hence, in such inverted variations, the opening of the channel 170 may have an upward orientation, and the insert member 150 may extend downward direction.

The depicted example channel 170 having a uniform height, width, and length. In some embodiments not shown, the housing 145 may further include one, two, three, or four surfaces extending from the opening of the channel 170 in a flaring manner such that the surfaces flare out from the opening of the channel 170. For example, in an embodiment with four surfaces flaring out from the opening of the channel 170, the surfaces may provide for a flared out bottom of the channel 170 that creates an extended opening for the channel 170 that increases in length and width as it extends. Such flared-out surfaces may provide for a funnel-like guiding of the insert section 130 into engagement with the housing 145 when the housing 145 is lowered onto the insert section 130 or vice versa so that the insert member 150 is firmly mated with the channel 170. In addition or in alternative, some embodiments of the channel 170 may be tapered such that the channel 170 does not have a uniform width and/or length. In such embodiments, the portion of the housing 145 forming the channel 170 may be formed to flare outward in width and/or length as it extends. Accordingly, such tapered embodiments may further enhance the gravity-fed placement and securement features of the interlock assembly 120. Still further, in some embodiments, the insert member 150 and the channel 170 may be additionally formed with corresponding tapers in order to provide a friction fit when the insert member 150 is fully mated with the channel 170. Thus, the insert member 150 may be dimensioned to have decreasing length and/or width as the insert member 150 becomes more distal from the rest of the insert section 130. Correspondingly, the channel 170 may be dimensioned to have increasing length and/or width as the channel 170 becomes more distal from the rest of the housing 145.

In alternative embodiments, the insert section 130 may be formed to have one or more nodules instead of the insert member 150. The one or more nodules may be upward facing or downward facing depending on the orientation of the embodiment. The housing 145 may include one or more corresponding cavities adapted to receive the one or more nodules, instead of the channel 170. Such nodule-cavity embodiments may be formed to provide the same or similar gravity-fed placement securement features as the insert-channel embodiments. Thus, for example, the one or more nodules in one or more corresponding cavities may be dimensioned to provide funnel-like guiding into engagement and/or friction fit.

Figure 3C:
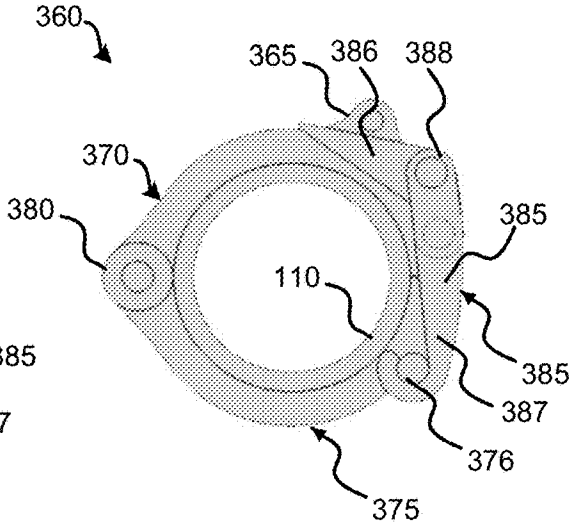
FIGS. 3A, 3B, and 3C illustrate a support member coupling, in accordance with certain embodiments of this disclosure.
Figure 3B:
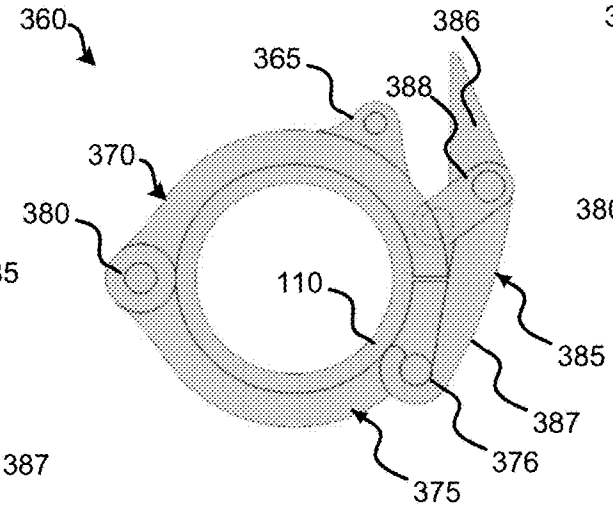
Figure 3A:
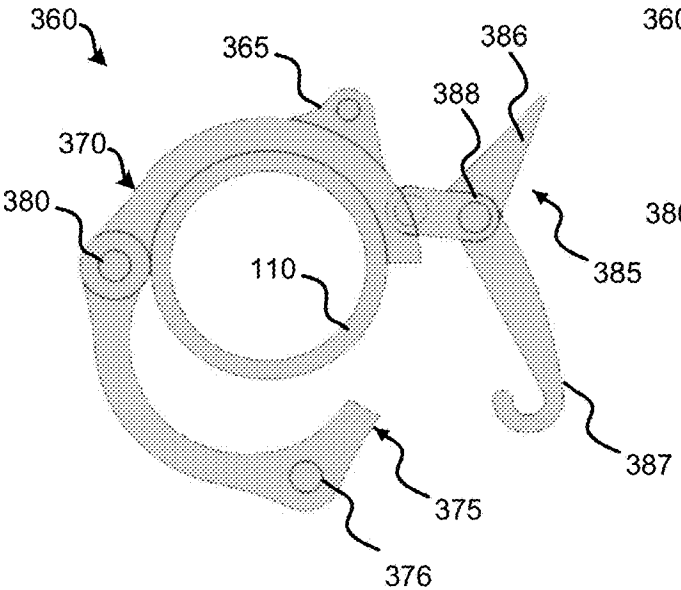

FIGS. 3A, 3B, and 3C illustrate a support member coupling 360, in accordance with certain embodiments of this disclosure. The support member coupling 360 (which may be referenced herein as a pole coupling or quick-release fastener) may be used instead of the support member coupling 160 in some embodiments in order to facilitate rapid securement to the support member 110 and rapid release therefrom when needed. In various embodiments, the support member coupling 360 may couple with the insert section 130 directly or indirectly by way of a laterally extending portion, such as the laterally extending portion 135. The support member coupling 360 may include one or more lateral extensions 365 to facilitate connection to the insert section 130 by way of one or more fasteners. In various embodiments, the lug-like lateral extension 365 may be fastened to, or formed with, a component of the support member coupling 360. The support member coupling 360 may include two or more hinged components 370, 375. The hinged components 370, 375 may be hingedly connected together via a hinge connection 380 that allows movement of the hinged components 370, 375 with respect to one another and allow for the hinged components 370, 375 to, together, partially or entirely wrap around an outer perimeter of the support member 110. FIG. 3A illustrates the support member coupling 360 with the hinged component 375 in a partially open and unwrapped state. FIGS. 3B and 3C illustrate the support member coupling 360 with the hinged component 375 in a closed and unwrapped state such that the hinged components 370, 375 partially or entirely wrap around an outer perimeter of the support member 110.

The support member coupling 360 may include a linkage mechanism 385 configured to allow for a rapid locking of the hinged components 370, 375 together and a quick release of the hinged components 370, 375 from one another. The linkage mechanism 385 may include a lever 386 and a clasp member 387 pivotably interconnected with one another and a linkage component 388 that pivotably interconnects with the hinged component 370. As illustrated, the class member 387 may be formed with a hook to engage a lug 376 of the hinged component 375. FIG. 3A illustrates the linkage mechanism 385 in unlocked state. FIGS. 3B and 3C illustrate the linkage mechanism 385 in partially locked state and fully locked state, respectively.

The components of the linkage system 385 may be adapted such that reactive forces and movements secure the hinged components 370, 375 together in a locked position about the support member 110, when the clasp member 387 selectively engages the lug 376 and sufficient force is selectively applied to the lever 386 to move the lever 386 and other components into the locked position. Likewise, opposing forces may be selectively applied to the lever 386 to release the components of the linkage system 385 from the locked position. Accordingly, the support member coupling 360 may provide for rapid securement (and release) of the interlock assembly 120 and, thereby, the antenna assembly 115 to the support member 110. Not only does this facilitate quicker installation and the installation, but also quicker rotational adjustment of the interlock assembly 120 and the antenna assembly 115 along the longitudinal axis of the support member 110 and about a plane that is perpendicular to the longitudinal axis.

Figure 4B:
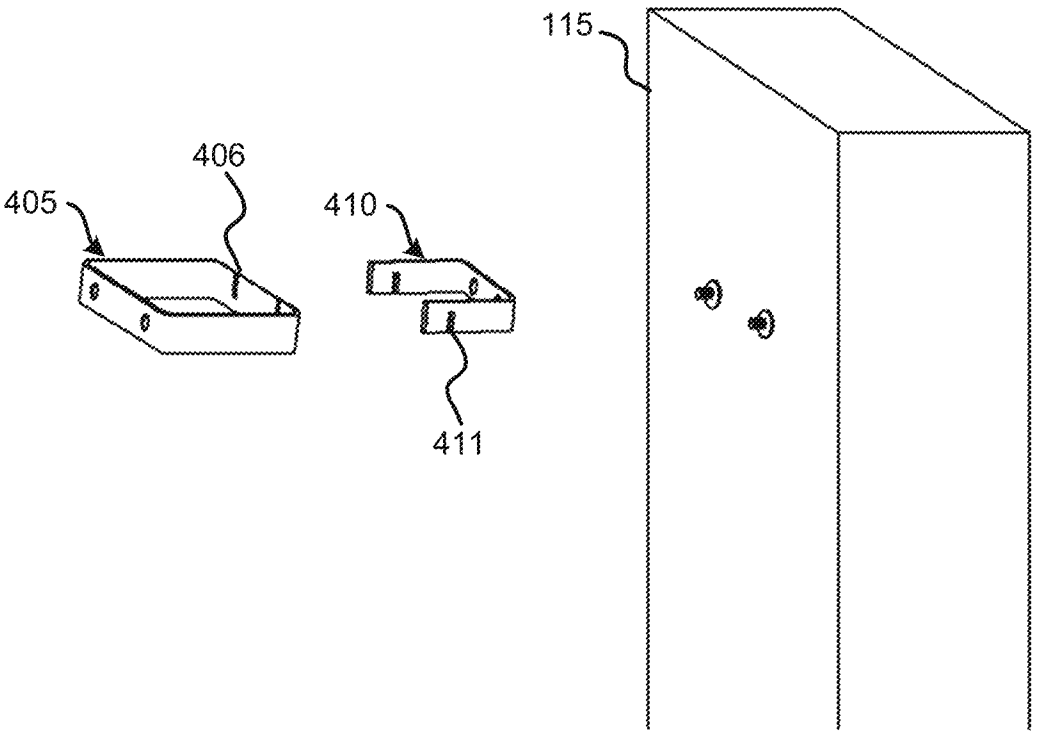
FIGS. 4A and 4B illustrate an alternative mounting system, in accordance with certain embodiments of this disclosure.
Figure 4A:
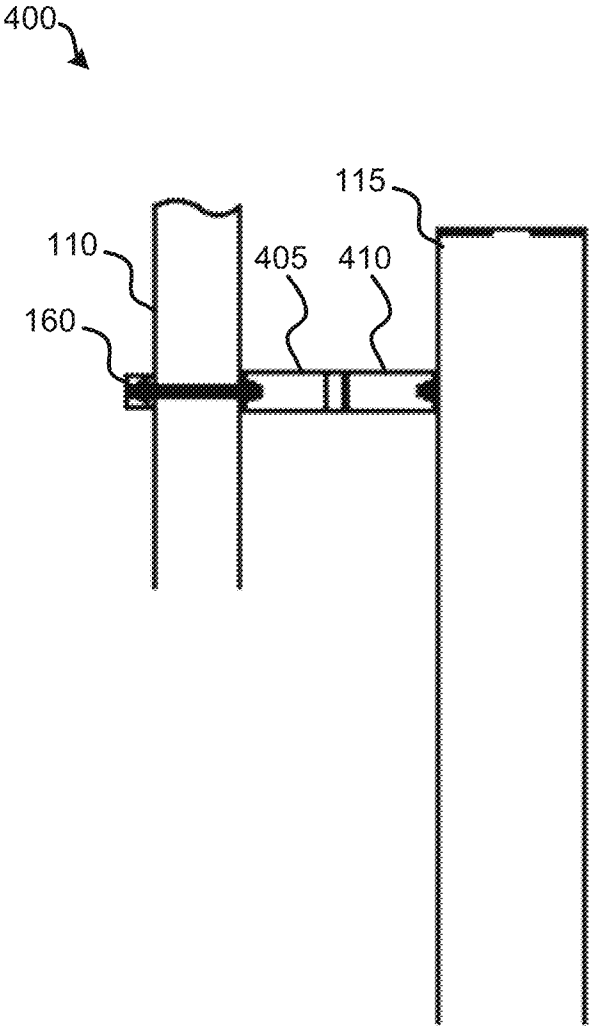

FIGS. 4A and 4B illustrate an alternative mounting system 400, in accordance with certain embodiments of this disclosure. FIG. 4A illustrates the mounting system 400 in an assembled state, securing the antenna assembly 115 to the support member 110. FIG. 4B illustrates a partial exploded view of the mounting system 400. The mounting system 400 may include two interlocking components 405 and 410. The interlocking component 405 may be fastened to the support member 110 via the support member coupling 160. The interlocking component 410 may be fastened to the antenna assembly 115 in any suitable manner. The interlocking components 405 and 410 may correspond to notched brackets that may be formed to include mating notches 406 and 411 that, when mutually engaged, locked the interlocking components 405 and 410 together and, thereby, allow for the suspension of the antenna assembly 115. Advantageously, the interlocking components 405 and 410 may be quickly formed in mass quanitites at scale via a metal-stamping process.

Therefore, various embodiments according to present disclosure are well adapted to attain the ends and advantages mentioned as well as those that are inherent therein. Specific details are given in the above description to provide a thorough understanding of the embodiments. However, it is understood that the embodiments may be practiced without these specific details. In other instances, well-known processes, structures, and techniques may be shown without unnecessary detail in order to avoid obscuring the embodiments.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Various embodiments may include any one or combination of features disclosed herein.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed:

1. A mounting system to secure a radio antenna, the mounting system comprising:

a mechanical interlock assembly that comprises:

a head section:

comprising a laterally extending portion; and adapted to couple with a pivotable coupling at least in part via the laterally extending portion, where the pivotable coupling is adapted to pivotably couple with an antenna assembly; and comprising a housing adjacent to the laterally extending portion;

an insert section:

adapted to couple with a pole coupling of a support member of a tower structure; and adapted to at least partially fit into the housing of the head section, where the housing is adapted to receive at least part of the insert section;

wherein the insert section at least partially fits into the housing of the head section to mechanically interlock the head section with the insert section to allow suspension of the antenna assembly from the support member.

2. The mounting system to secure a radio antenna as recited in claim 1, further comprising:

a first extension member engaged with the insert section;

where the insert section couples with the support member at least partially with the first extension member.

3. The mounting system to secure a radio antenna as recited in claim 2, further comprising:

a second extension member engaged with the head section;

where the head section couples with the pivotable coupling at least partially with the second extension member.

4. The mounting system to secure a radio antenna as recited in claim 3, further comprising the pivotable coupling adapted to pivotably couple with the antenna assembly.

5. The mounting system to secure a radio antenna as recited in claim 4, further comprising the pole coupling, where the pole coupling is a quick-release fastener adapted to wrap at least partially around the support member.

6. The mounting system to secure a radio antenna as recited in claim 5, where the quick-release fastener comprises a latch to selectively fasten and release the quick-release fastener.

7. The mounting system to secure a radio antenna as recited in claim 6, wherein the housing is formed to at least partially define a channel adapted to receive at least the part of the insert section.

8. A method for a mounting system to secure a radio antenna, the method comprising:

forming a head section of a mechanical interlock assembly to comprise a laterally extending portion and a housing adjacent to the laterally extending portion, the forming comprising adapting the head section to couple with a pivotable coupling at least in part via the laterally extending portion, where the pivotable coupling is adapted to pivotably couple with an antenna assembly; and forming an insert section of the mechanical interlock assembly, the forming comprising:

adapting the insert section to couple with a pole coupling of a support member of a tower structure; and adapting the insert section to at least partially fit into the housing of the head section, where the housing is adapted to receive at least part of the insert section;

where the insert section and the housing of the section are formed so that the insert section at least partially fits into the housing of the head section to mechanically interlock the head section with the insert section to allow suspension of the antenna assembly from the support member.

9. The method for a mounting system to secure a radio antenna as recited in claim 8, the method further comprising:

engaging a first extension member with the insert section;

where the insert section couples with the support member at least partially with the first extension member.

10. The method for a mounting system to secure a radio antenna as recited in claim 9, the method further comprising:

engaging a second extension member with the head section;

where head section couples with the pivotable coupling at least partially with the second extension member.

11. The method for a mounting system to secure a radio antenna as recited in claim 10, the method further comprising:

adapting the pivotable coupling to pivotably couple with the antenna assembly.

12. The method for a mounting system to secure a radio antenna as recited in claim 11, the method further comprising:

adapting the pole coupling to comprise a quick-release fastener adapted to wrap at least partially around the support member.

13. The method for a mounting system to secure a radio antenna as recited in claim 12, where the quick-release fastener comprises a latch to selectively fasten and release the quick-release fastener.

14. The method for a mounting system to secure a radio antenna as recited in claim 13, wherein the housing is formed to at least partially define a channel adapted to receive at least the part of the insert section.

15. A method of securing a radio antenna, the method comprising:

mechanically interlocking a head section of a mechanical interlock assembly with an insert section of the mechanical interlock assembly, where the head section comprises a laterally extending portion and a housing adjacent to the laterally extending portion;

coupling the head section with a pivotable coupling at least in part via the laterally extending portion, where the pivotable coupling is adapted to pivotably couple with an antenna assembly;

coupling the insert section with a pole coupling of a support member of a tower structure; and at least partially fitting the insert section into the housing of the head section, where the housing is adapted to receive at least part of the insert section, and the insert section at least partially fits into the housing of the head section to mechanically interlock the head section with the insert section to allow suspension of the antenna assembly from the support member.

16. The method of securing as recited m claim 15, the method further comprising:

engaging a first extension member with the insert section;

where the insert section couples with the support member at least partially with the first extension member.

17. The method of securing a radio antenna as recited in claim 16, the method further comprising:

engaging a second extension member with the head section;

where head section couples with the pivotable coupling at least partially with the second extension member.

18. The method of securing a radio antenna as recited in claim 17, the method further comprising:

adapting the pivotable coupling to pivotably couple with the antenna assembly.

19. The method of securing a radio antenna as recited in claim 18, where the pole coupling is a quick-release fastener adapted to wrap at least partially around the support member.

20. The method of securing a radio antenna as recited in claim 19, wherein the housing is formed to at least partially define a channel adapted to receive at least the part of the insert section.

* * * * *